US007673609B2

(12) United States Patent
Inui et al.

(10) Patent No.: US 7,673,609 B2
(45) Date of Patent: Mar. 9, 2010

(54) INTERNAL COMBUSTION ENGINE

(75) Inventors: Hiroatsu Inui, Saitama (JP); Tomokazu Baba, Saitama (JP); Hideyuki Tawara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 123 days.

(21) Appl. No.: 11/902,456

(22) Filed: Sep. 21, 2007

(65) Prior Publication Data

US 2008/0184956 A1 Aug. 7, 2008

(30) Foreign Application Priority Data

Sep. 26, 2006 (JP) ..... 2006-261279

(51) Int. Cl.
*F02M 35/10* (2006.01)

(52) U.S. Cl. ..... 123/193.5; 123/90.27

(58) Field of Classification Search ..... 123/193.5, 123/193.3, 90.27
See application file for complete search history.

(56) References Cited

U.S. PATENT DOCUMENTS 4,763,624 A * 8/1988 Deckers ..... 123/432
5,535,710 A * 7/1996 Zoschke et al. ..... 123/90.23
5,685,265 A * 11/1997 Yoshikawa ..... 123/90.27
5,704,330 A * 1/1998 Tsuchida ..... 123/193.5
5,901,675 A * 5/1999 Nakagomi ..... 123/90.27
6,035,822 A * 3/2000 Suzuki et al. ..... 123/276
6,039,029 A * 3/2000 Nagasaka et al. ..... 123/442
2009/0007860 A1 * 1/2009 Kato et al. ..... 123/41.85

FOREIGN PATENT DOCUMENTS

JP 1-16983 B2 3/1989

* cited by examiner

*Primary Examiner*—M. McMahon
(74) *Attorney, Agent, or Firm*—Birch, Stewart, Kolasch & Birch, LLP

(57) ABSTRACT

In an internal combustion engine in which air-intake valves reciprocate in parallel to the direction of reciprocal motion of pistons, an air-intake structure of an internal combustion engine includes an outward projection of the air-intake port that is reduced to achieve a downsizing of a cylinder head. An air-intake structure includes air-intake valves that are supported by a cylinder head having integrally formed air-intake ports so as to reciprocate in parallel with the direction of reciprocal motion of the pistons. Fuel injection devices are formed integrally with a throttle body on intake manifolds to be connected to the air-intake ports. The air-intake ports extend toward the cylinder head cover along a recess formed on the outer surface of the cylinder head that is connected to the intake manifolds at positions just before reaching the identical plane to a mating surface between the cylinder head and the cylinder head cover.

20 Claims, 7 Drawing Sheets

INTERNAL COMBUSTION ENGINE

CROSS-REFERENCE TO RELATED APPLICATIONS

The present application claims priority under 35 USC 119 to Japanese Patent Application No. 2006-261279 filed on Sep. 26, 2006 the entire contents of which are hereby incorporated by reference.

BACKGROUND OF THE INVENTION

1. Field of the Invention

The present invention relates to an air-intake structure of an internal combustion engine.

2. Description of Background Art

An internal combustion engine having a structure is known wherein air-intake valves reciprocate in parallel with the reciprocal motion of pistons, and cams of a camshaft directly press the air-intake valves. See, for example, JP-B-1-16983.

Since the internal combustion engine described above has a structure in which the direction of the reciprocal motion of the pistons is in parallel with the air-intake valves, the opening planes of air-intake ports opening into a combustion chamber are parallel to the mating surface of a cylinder head with respect to a cylinder block, and the air-intake ports are bent from the opening planes and extend obliquely upwardly, and extend further outwardly from the side wall of the cylinder head.

The air-intake ports disclosed in JP-B-1-16983 project outwardly from the side wall of the cylinder head and extend upwardly up to the mating surface of the cylinder head with respect to a cylinder head cover, and then are connected to air-intake pipes (intake manifolds), and the air-intake pipes extend so as to curve across the portion above the cylinder head cover.

Fuel injection nozzles are provided on the air-intake pipes.

Since the air-intake ports projecting outwardly from the cylinder head swell outwardly and extend upwardly to the mating surface of the cylinder head with respect to the cylinder head cover, the air-intake ports protrude significantly outwardly of the cylinder head, so that the cylinder head is upsized.

SUMMARY AND OBJECTS OF THE INVENTION

In view of such problems, it is an object of the invention to provide an air-intake structure of an internal combustion engine in which air-intake valves reciprocate in parallel with the direction of the reciprocal motion of pistons, wherein outward protrusion of an air-intake port is reduced to downsize a cylinder head.

According to an embodiment of the present invention, an air-intake structure of an internal combustion engine is provided in which air-intake valves are supported by a cylinder head having integrally formed air-intake ports so as to reciprocate in parallel with the direction of reciprocal motion of pistons. Fuel injection devices are formed integrally with a throttle body and are provided on intake manifolds to be connected to the air-intake ports. The air-intake ports extending toward a cylinder head cover along a recess formed on the outer surface of the cylinder head is connected to the intake manifolds at positions just before reaching the identical plane to a mating surface between the cylinder head and the cylinder head cover.

According to an embodiment of the present invention, the connecting portions between the air-intake ports and the intake manifolds are positioned beside lifter guide holes of the cylinder head which slidably support valve lifters of the air-intake valves.

According to an embodiment of the present invention, a camshaft, which directly presses the air-intake valves, is positioned on the mating surface between the cylinder head and the cylinder head cover, and a recess which continues from the recess of the cylinder head is formed also on the cylinder head cover which is to be laid on the cylinder head. In addition, the intake manifolds to be connected to the air-intake ports extends along the recess of the cylinder head cover.

According to an embodiment of the present invention, the air-intake port extends towards the cylinder head cover along the recessed formed on the outer surface of the cylinder head and is connected to the intake manifold at the position just before reaching the identical plane as the mating surface between the cylinder head and the cylinder head cover. Thus, the cylinder head may be downsized.

According to an embodiment of the present invention, the connecting portions between the air-intake port and the intake manifold are positioned beside the lifter guide hole of the cylinder head which slidably supports the valve lifter of the air-intake valve of the cylinder head. Thus, the lifter guide hole is protected by the intake manifold.

According to an embodiment of the present invention, the intake manifold to be connected to the air-intake port extends along the recess of the cylinder head cover which continues from the recess of the cylinder head, the camshaft positioned on the mating surface of the cylinder head and the cylinder head cover may be protected by the intake manifold.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring now to FIG. 1 to FIG. 7, an embodiment of the invention will be described.

Figure 1:
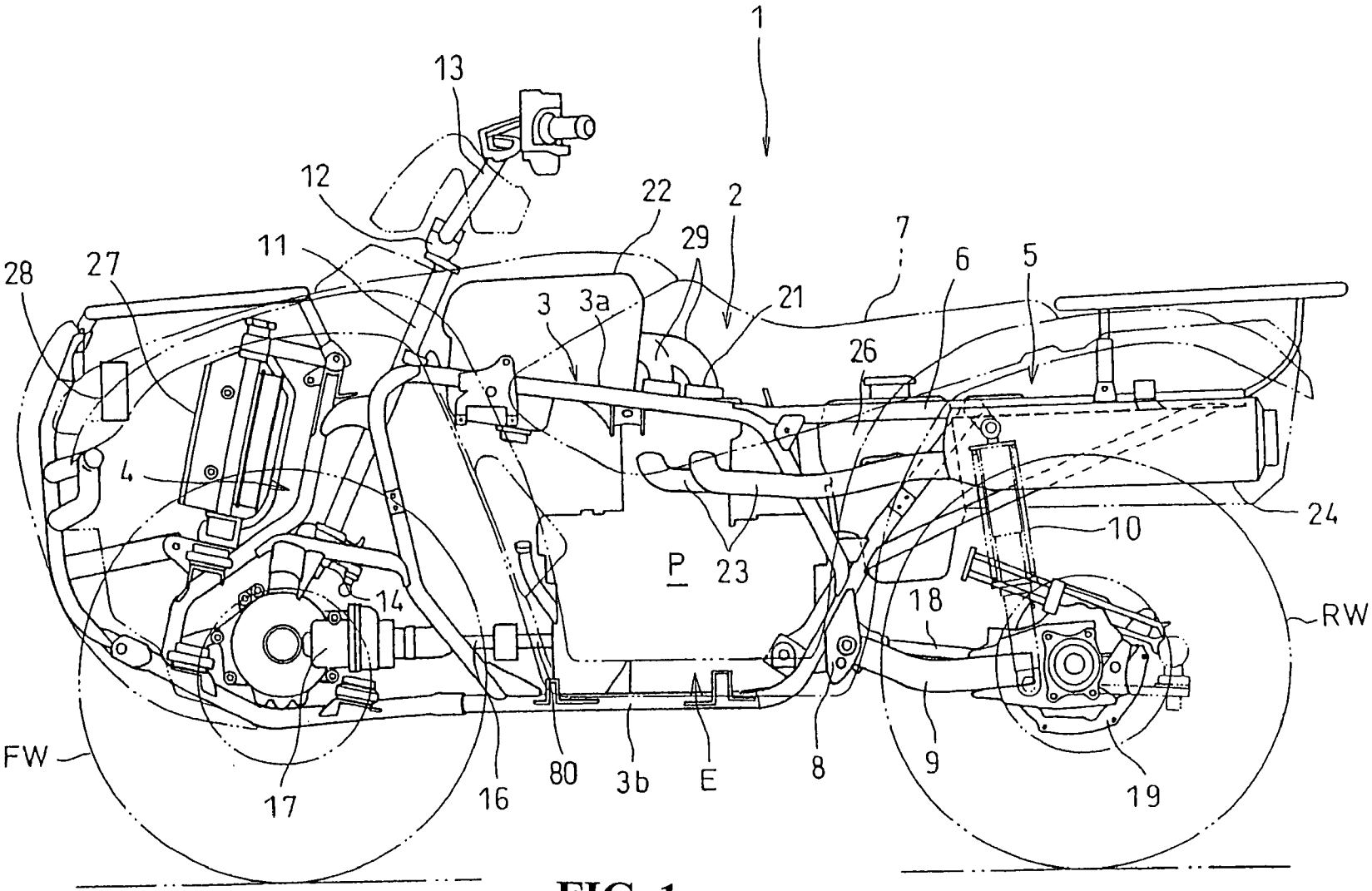
FIG. 1 is a side view of a rough-terrain traveling vehicle in which a power unit according to an embodiment of the invention is mounted with a vehicle body cover or the like removed.
Figure 2:
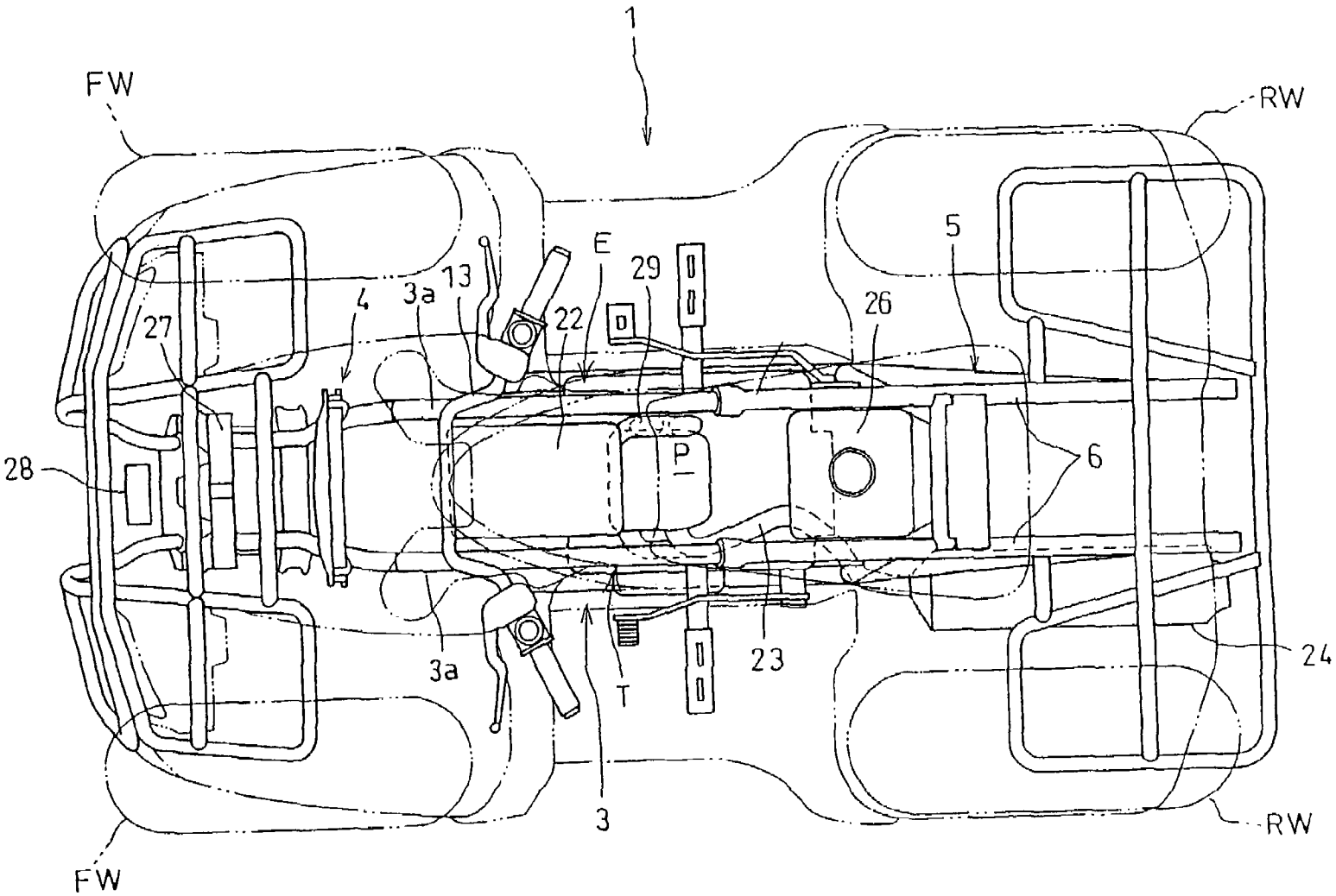
FIG. 2 is a plan view of the same.

A side view of a rough-terrain traveling vehicle 1 in which a water-cooled internal combustion engine E according to this embodiment is mounted in a state in which a vehicle body cover is removed is shown in FIG. 1. A plan view of the same is shown in FIG. 2.

In this embodiment, the front, rear, left and right are defined on the basis of a direction viewing in the direction of travel of the vehicle.

The rough-terrain traveling vehicle 1 is a saddle type four-wheel vehicle with a pair of left and right front wheels FW on which low-pressure balloon tires for rough-terrain are mounted and a pair of left and right rear wheels RW on which the same balloon tires are mounted are suspended in the front and rear of a vehicle body frame 2.

The vehicle body frame 2 is configured with a plurality of types of wheel material joined together, and includes a center frame portion 3 in which a power unit P having the internal combustion engine E and a transmission T provided integrally in a crankcase 31, a front frame 4 connected to the front portion of the center frame portion 3 for suspending the front wheels FW, and a rear frame portion 5 connected to the rear portion of the center frame portion 3 and having a seat rail 6 for supporting a seat 7.

The center frame portion 3 includes a pair of left and right upper pipes 3*a* and a pair of left and right lower pipes 3*b*, the upper pipes 3*a* each substantially forming three sides by being bent downwardly at front and rear thereof, and the lower pipes 3*b* each substantially forming one side to form substantially a rectangular shape in side view, and the left and right pipes are connected by a cross member.

Swing arms 9 whose front ends are supported rotatably via a shaft by pivot plates 8 fixed to portions of the lower pipes 3*b* extend obliquely upwardly at the rear end thereof with rear shock absorbers 10 being provided between the rear portion of the swing arms 9 and the rear frame portion 5. The rear wheels RW are suspended by rear final reduction gear units 19 provided at the rear ends of the swing arms 9.

A steering column 11 is supported at the lateral center of the cross member extending between the front end portions of the left and right upper pipes 3*a*. A steering handle 13 is connected to the upper end portion of a steering shaft 12 steerably supported by the steering column 11 with the lower end portion of the steering shaft 12 being connected to a front wheel steering mechanism 14.

The internal combustion engine E of the power unit P is a water-cooled two-cylinder internal combustion engine mounted to the center frame portion 3 with a crankshaft 30 oriented in the fore-and-aft direction of a vehicle body, that is, in a so-called vertical posture.

The transmission T of the power unit P is arranged on the left-hand side of the internal combustion engine E with an output shaft 80 oriented in the fore-and-aft direction projecting toward the front and rear from the transmission T at a position which is displaced toward the left, so that a rotational force of the output shaft 80 is transmitted from the front end of the output shaft 80 to the left and right front wheels FW via a front drive shaft 16 and a front final reduction gear unit 17. Power is transmitted from the rear end thereof to the left and right rear wheels RW via rear drive shafts 18 and the rear final reduction gear units 19.

A radiator 27 is supported in the front frame portion 4 of the vehicle body frame 2, and an oil cooler 28 is disposed in front thereof.

Figure 3:
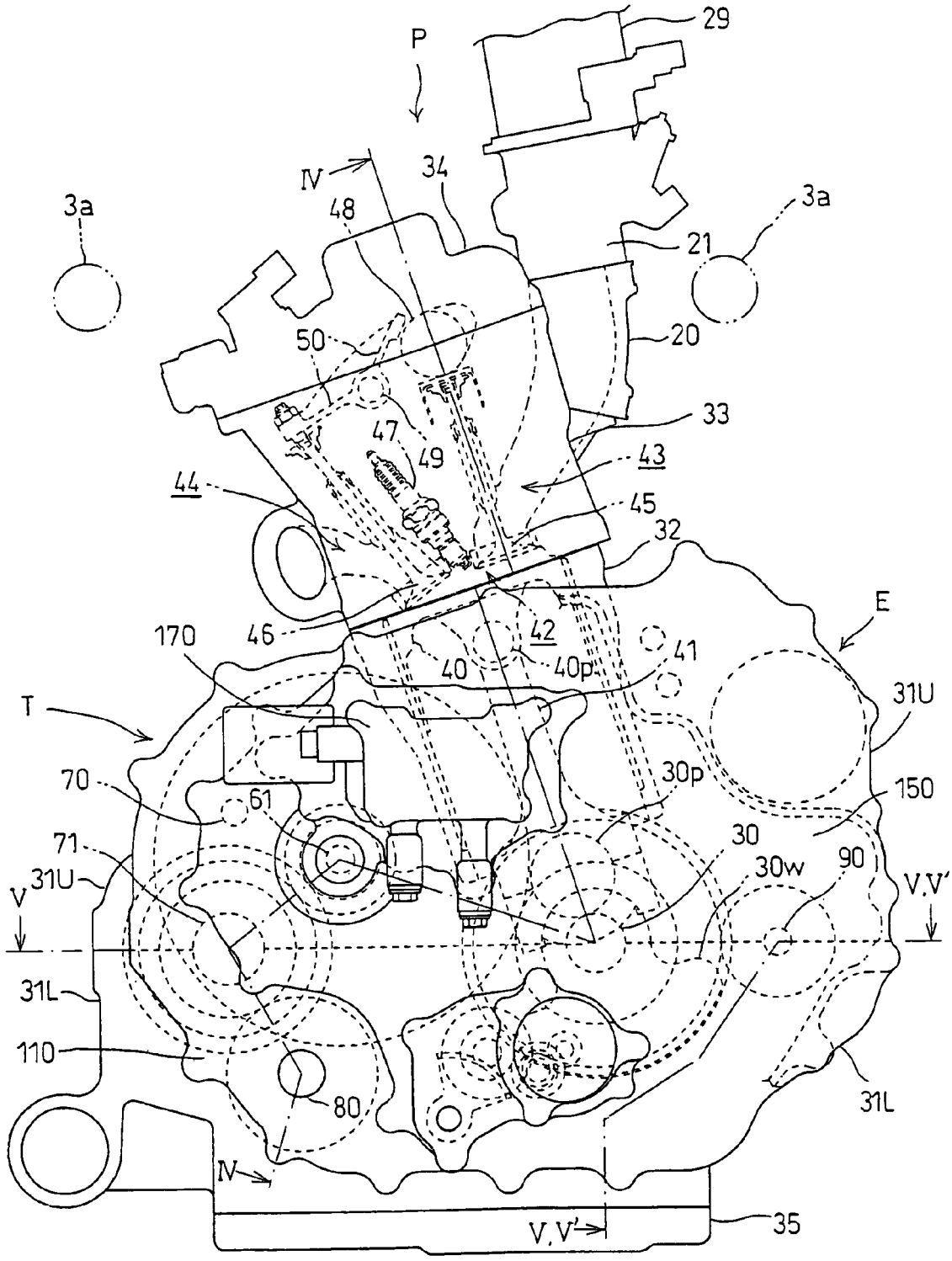
FIG. 3 is a rear view of the power unit.

Referring to FIG. 3, a rear view of the power unit P wherein crankcase contains the internal combustion engine E and the transmission T of the power unit P in the interior thereof with a vertically divided structure that is divided into upper and lower halves, that is, an upper crankcase 31U and a lower crankcase 31L, along a plane including the crankshaft 30.

A cylinder block portion 32 formed integrally with the upper crankcase 31U at the upper portion thereof with two cylinder bores 32*c*, arranged in series, are formed so as to incline slightly toward the left and extend upwardly, a cylinder head 33 is placed on the top of the cylinder block portion 32, and the cylinder head 33 is covered with a cylinder head cover 34.

On the other hand, an oil pan 35 is attached to the bottom of the lower crankcase 31L.

An intake manifold 20 extends substantially upwardly inflectionally from a right wall of the cylinder head 33 and interposes a fuel injection device 21I together with a throttle body 21 at midway point. An air-intake connecting pipe 29, connected to the throttle body 21, is connected to an air cleaner 22 arranged upwardly of the internal combustion engine E. An exhaust pipe 23 extends leftward so as to curve from a left wall of the cylinder head 33 and is connected to an exhaust muffler 24 mounted to the left side of a rear frame unit 5.

The fuel injection device 21I receives a supply of fuel from a fuel tank 26 arranged rearwardly of the power unit P.

Since it is not necessary to provide a member for supporting the fuel injection device 21I separately by configuring the fuel injection device 21I integrally with the throttle body 21, the cost of the fuel injection device 21I may be reduced.

Figure 4:
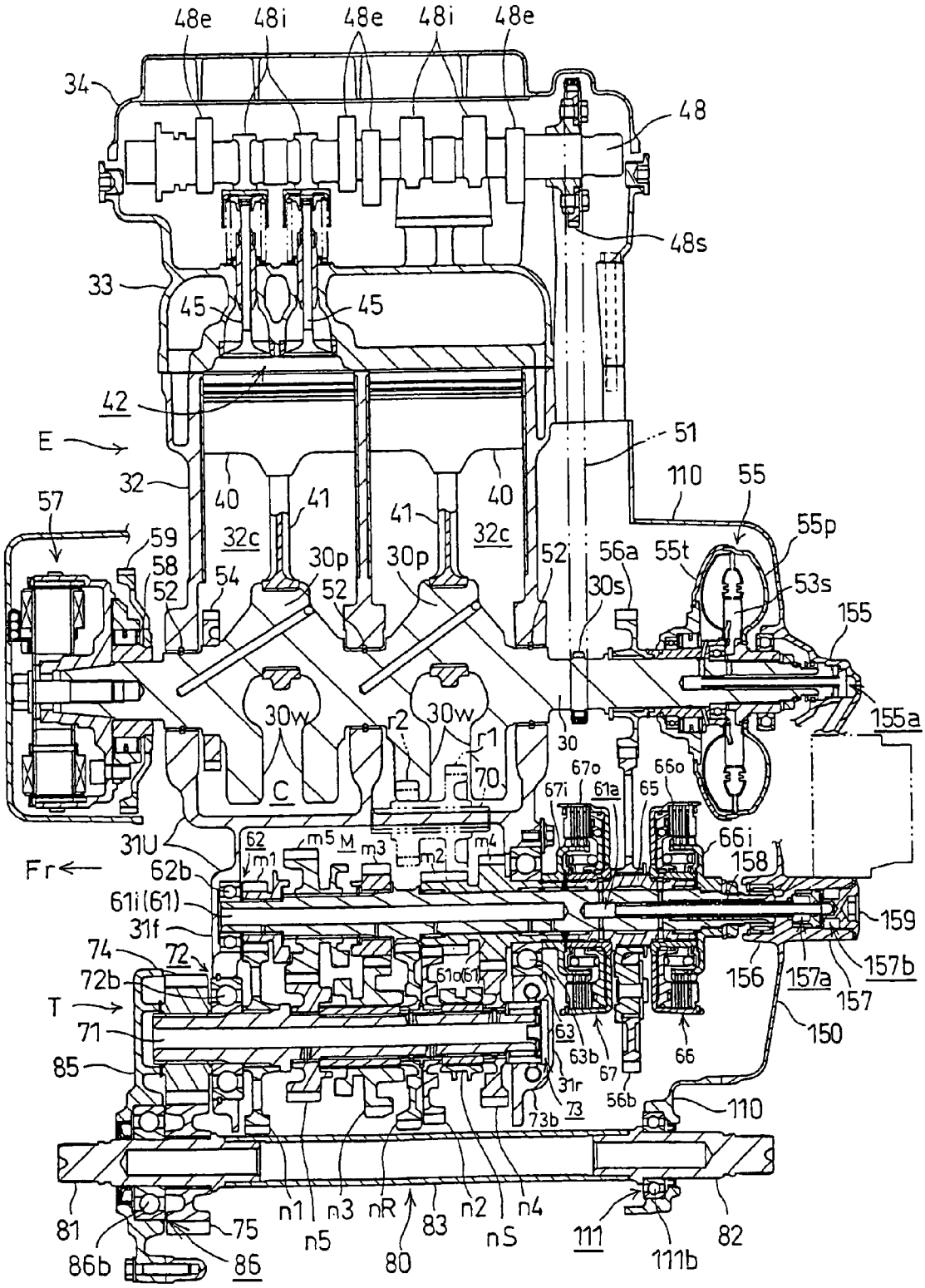
FIG. 4 is a developed cross-sectional view of the power unit (taken along the line IV-IV in FIG. 3)

Referring now to FIG. 3 and FIG. 4, pistons 40 are fitted to the two cylinder bores 32*c* of the cylinder block portion 32 so as to be capable of sliding reciprocation. In addition, crank pins 30*p* between crank webs 30*w*, 30*w* of the crankshaft 30 and piston pins 40*p* of the pistons 40 are connected by connecting rods 41, so that a crank mechanism is configured.

In the cylinder head 33, each cylinder bore 32*c* includes a combustion chamber 42 opposing the pistons 40, an air-intake port 43 opening into the combustion chamber 42 and extending rightwardly and upwardly so as to be opened and closed by a pair of air-intake valves 45, exhaust ports 44 extending forward so as to be opened and closed by a pair of exhaust valves 46, and ignition plugs 47 mounted thereto so as to be exposed into the combustion chamber 42.

The intake manifold 20 are connected to the air-intake ports 43.

By adjusting the length of the intake manifold 20, the throttle body 21 may be positioned apart from the cylinder head 33 by a predetermined distance, so that the throttle body 21 may be protected from heat.

In the cylinder head 33, the air-intake valve 45 is supported so as to be capable of reciprocating in parallel with the reciprocal motion of the piston 40. Thus, a valve stem 45*s* of the air-intake valve 45 extends in parallel with the center axis of the cylinder bore 32*c*, and the opening plane of the air-intake port 43 opening into the combustion chamber 42 extends in parallel with the mating surface of the cylinder head 33 with respect to the cylinder block 32.

The upper ends of the air-intake valves 45 come into abutment with air-intake cam lobes 48*i* of a camshaft 48, which is rotatably supported by the cylinder head 33 via a shaft. One end of a locker arm 50 rotatably supported by a rocker arm shaft 49 via a shaft comes into abutment with exhaust cam lobes 48*e* of the camshaft 48. In addition, the upper ends of the exhaust valves 46 come into abutment with the other ends of the rocker arms 50.

Therefore, the air-intake valves 45 and the exhaust valves 46 open and close the air-intake ports 43 and the exhaust ports 44 synchronously with the rotation of the crankshaft 30 by the camshaft 48 at a predetermined timing.

In order to do so, the camshaft 48 is fitted with a cam sprocket 48*s* at the rear portion thereof, and a timing chain 51 is wound between a drive sprocket 30*s* fitted to the portion of the crankshaft 30 near the rear end portion thereof and the cam sprocket 48*s* (see FIG. 4), so that the camshaft 48 is driven to rotate at half the revolving speed of the crankshaft 30.

The crankshaft 30 is rotatably supported by being clamped between the upper crankcase 31U and the lower crankcase 31L via a plane bearing 52. As shown in FIG. 4, the rear portion of the crankshaft 30 projecting rearwardly from a crank chamber is formed with the drive sprocket 30*s*, and a primary drive gear 56*a* is provided on further rear ends thereof via a fluid coupling 55 as a fluid joint.

The fluid coupling 55 includes a pump impeller 55*p* fixed to the crankshaft 30, a turbine runner 55*t* opposed thereto, and a stator 53*s*.

The primary drive gear 56*a* is joined with the turbine runner 55*t* which is rotatable with respect to the crankshaft 30, and the power from the crankshaft 30 is transmitted to the primary drive gear 56*a* via hydraulic oil.

The primary drive gear 56*a* meshes with a primary driven gear 56*b* which is rotatably supported by a main shaft 61, described later, and transmits the rotation of the crankshaft 30 to the main shaft 61 side.

On the other hand, a starting driven gear 59 is supported by the front side portion of the crankshaft 30 projecting forward from a crank chamber C via an AC generator 57 and a one way clutch 58.

A balancer shaft drive gear 54 is fitted to a portion of the crankshaft 30 extending along the inner surface of the front wall of the crank chamber C.

A transmission chamber M is defined by being partitioned by a partitioning wall in the left side of the crank chamber C that accommodates the crank webs 30*w* of the crankshaft 30.

A transmission gear mechanism 60 accommodated in the transmission chamber M is a constantly engaging gear mechanism, in which the main shaft 61 is supported by the upper crankcase 31U at a position leftward and obliquely upwardly of the crankshaft 30. A counter shaft 71 is supported on a partitioning plane by being sandwiched between the upper and lower crankcases 31U, 31L at a position leftward and obliquely downwardly of the main shaft 61 and leftward of the crankshaft 30 (see FIG. 3).

The main shaft 61 includes an inner cylinder 61*i* and an outer cylinder 61*o* which rotatably fits on part of the inner cylinder 61*i*. The front end of the inner cylinder 61*i* is rotatably supported by a bearing recess 62 formed on a front wall 31*f* of the transmission chamber M of the upper crankcase 31U with the intermediary of a bearing 62*b*, the outer cylinder 61*o* is fitted on the inner cylinder 61*i* substantially at a center position on the rear side so as to be capable of relative rotation. Part of the outer cylinder 61*o* is rotatably supported by a bearing opening 63 formed on a rear wall 31*r* of the transmission chamber M with the intermediary of a bearing 63*b* and is supported together with the inner cylinder 61*i*.

The outer cylinder 61*o* is integrally formed with a second transmission drive gear m2 and a fourth transmission drive gear m4 at the front and back respectively on a portion inside the bearing 63*b* and the outer portion projects partly outwardly from the bearing 63*b*.

On the inner cylinder 61*i*, a first transmission drive idle gear m1, a fifth transmission drive gear m5 formed integrally with a shifter and spline-fitted to the inner cylinder 61*i* and a third transmission drive idle gear m3 in sequence from the front on the front side of the second and fourth transmission drive gears m2 and m4 on the outer cylinder 61*o* are supported. The outer portion of the inner cylinder 61*i* projects rearwardly from the outer portion of the outer cylinder 61*o*.

The bearing recess 62 formed on the front wall 31*f* is formed to have a small inner diameter for supporting the front end of the inner cylinder 61*i* having a small diameter, while the bearing opening 63 formed on the rear wall 31*r* is formed to have an inner diameter smaller than the fifth transmission drive gear m5 having the largest diameter and larger than the diameter of the fourth transmission drive gear m4, and is used for assembling work of the main shaft 61.

An input sleeve 65 is rotatably fitted on the outer portion of the inner cylinder 61*i* in juxtaposition with the outer cylinder 61*o*. The primary driven gear 56*b* is fitted at the center of the input sleeve 65, so that the primary driven gear 56*b* meshes with the primary drive gear 56*a* on the side of the crankshaft 30.

A first transmission clutch 66 is assembled to the input sleeve 65 at a position rearwardly of the primary driven gear 56*b*, and a second transmission clutch 67 is assembled thereto at a position forwardly of the primary driven gear 56*b*.

A pair of the first transmission clutch 66 and the second transmission clutch 67 are hydraulic multiple disk clutches having the same structure.

The first transmission clutch 66 includes a cup-shaped clutch outer 66*o* opening rearward and integrally fitted to the input sleeve 65. A clutch inner 66*i* is integrally fitted to the internal cylinder 61*i*.

On the other hand, the second transmission clutch 67 includes a cup-shaped clutch outer 67*o* opening forward and integrally fitted to the input sleeve 65 with a clutch inner 67*i* integrally fitted to the outer portion of the outer cylinder 61*o*.

When hydraulic pressure is supplied to the first transmission clutch 66 and hence the clutch outer 66*o* and the clutch inner 66*i* are connected, the rotation of the input sleeve 65 which is integral with the primary driven gear 56*b* is transmitted to the rotation of the second and fourth transmission drive gears m2, m4 of the outer cylinder 61*o*, and when hydraulic pressure is not supplied, the clutch outer 66*o* and the clutch inner 66*i* are disconnected and the rotation is not transmitted to the second and fourth transmission drive gears m2 and m4 of the outer cylinder 61*o*.

In the same manner, when the hydraulic pressure is supplied to the second transmission clutch 67 and hence the clutch outer 67*o* and the clutch inner 67*i* are connected, the rotation of the input sleeve 65 which is integral with the primary driven gear 56*b* is transmitted to the inner cylinder 61*i*. Thus, the fifth transmission drive gear m5 spline-fitted to the inner cylinder 61*i* is rotated. When the hydraulic pressure is not supplied, the clutch outer 67*o* and the clutch inner 67*i* are disconnected. Thus, the rotation is not transmitted to the fifth transmission drive gear m5 on the inner cylinder 61*i*.

The counter shaft 71 supported on a partitioning plane by being sandwiched between the upper and lower crankcases 31U, 31L at a position leftward and obliquely downwardly of the main shaft 61 as described above is rotatably supported at the front portion by a bearing opening 72 formed on the front wall 31*f* of the transmission chamber M via a bearing 72*b*, and is rotatably supported at the rear end thereof by a bearing recess 73 formed on the rear wall 31*r* of the transmission chamber M via a bearing 73*b*.

A first transmission driven gear n1, a fifth transmission driven idle gear n5, a third transmission driven gear n3 formed integrally with the shifter and spline-fitted to the counter shaft 71, a reverse idle gear nR, a second transmission driven idle gear n2, a shifter nS, a fourth transmission driven idle gear n4 are arranged and supported rotatably by the counter shaft 71 via a shaft in sequence from the front in the transmission chamber M.

The corresponding transmission drive gear and the transmission driven gear are constantly meshed with each other.

A reverse idle shaft 70 is disposed at a position above the counter shaft 71 (see FIG. 3 and FIG. 4). A reverse large diameter gear r1 and a reverse small diameter gear r2 are supported by the reverse idle shaft 70 so as to rotate integrally. The reverse large diameter gear r1 meshes with the second transmission drive gear m2 on the main shaft 61, and the reverse small diameter gear r2 meshes with the reverse gear nR on the counter shaft 71.

The fifth transmission drive gear m5 on the main shaft 61 and the third transmission driven gear n3 on the counter shaft 71 are shifter gears, and the two shifter gears and the shifter nS on the counter shaft 71 are shifted in the axial direction by the transmission drive mechanism, so that transmission speeds are achieved.

In other words, the first speed and the third speed are achieved by the fore-and-aft shifting of the fifth transmission drive gear m5, the fifth speed and reverse movement are achieved by the fore-and-aft shifting of the third transmission driven gear n3, and the second speed and the fourth speed are achieved by the fore-and-aft shifting of the shifter nS.

The switching control of the transmission speeds and the control of the first transmission clutch 66 and the second transmission clutch 67 cooperate to transmit the power in the respective transmission speeds.

The front end of the counter shaft 71 projects forwardly from the bearing 72*b*, and an output gear 74 is spline-fitted to the front end.

The output shaft 80 is disposed downwardly and obliquely rightward of the counter shaft 71 (see FIG. 3). A driven gear 75 is spline-fitted to the front portion of the output shaft 80 for meshing with the output gear 74 at the front end of the counter shaft 71, so that power is transmitted from the counter shaft 71 to the output shaft 80.

Since a load larger than the meshing between the output shaft 80 and the driven gear 75 is applied to the output gear 74 at the front end of the counter shaft 71, the bearing 72*b* for rotatably supporting the front portion of the counter shaft 71, which is employed here, is relatively large.

Therefore, the inner diameter of the bearing opening 72 for fitting the bearing 72*b* of the front wall 31*f* is also large. However, since the bearing recess 62 of the adjacent main shaft 61 is small as descried before, the strength of the front wall 31*f* of the crankcase 31 around the output gear 74 may be maintained at a high level.

A front case cover 85 covers the upper and lower crankcases 31U, 31L configured to be divided into upper and lower halves so as to extend across the partitioning plane on the front surface from which the counter shaft 71 and the output shaft 80 project. A rear case cover 150 covers the upper and lower crankcase 31U, 31L so as to extend across the partitioning plane on the rear surface and covers the fluid coupling 55 at the rear end of the crankshaft 30. The first and second transmission clutches 66 and 67 at the rear ends of the main shaft 61 via a spacer 110 also serves partly as a case cover.

The output shaft 80 is configured with a front end borne portion 81 and a rear end borne portion 82 which are formed by casting and connected by a hollow cylindrical member 83. The front end borne portion 81 is rotatably supported by a bearing opening 86 formed on the front case cover 85 via a bearing 86*b* with the front end projecting forward, and the rear end borne portion 82 is rotatably supported by a bearing opening 111 formed on the spacer 110 via a bearing 111*b* with the rear end projecting rearward.

In other words, the output shaft 80 is rotatably supported by the front case cover 85 and the spacer 110 with the front end borne portion 81 and the rear end borne portion 82 projecting from the front and rear respectively.

The driven gear 75 is spline-fitted to the front end borne portion 81 to be adjacent to be inside a bearing 85*b*.

Therefore, the output gear 74 at the front end of the counter shaft 71 meshes the driven gear 75 spline-fitted to the front end borne portion 81 of the output shaft 80, so that power is transmitted from the counter shaft 71 to the output shaft 80.

Since the output shaft 80 is configured with the front end borne portion 81 and the rear end borne portion 82 which are formed by casting and connected by the hollow cylindrical member 83, the weight of the output shaft 80 may be reduced. Thus, a casting apparatus may be downsized as compared to the casting and molding of the entire output shaft as in the related art.

On the other hand, a balancer shaft 90 is rotatably supported by being sandwiched on the partitioning plane between the upper and lower crankcases 31U and 31L at a position to the right of the crankshaft 30 (see FIG. 3).

Figure 5:
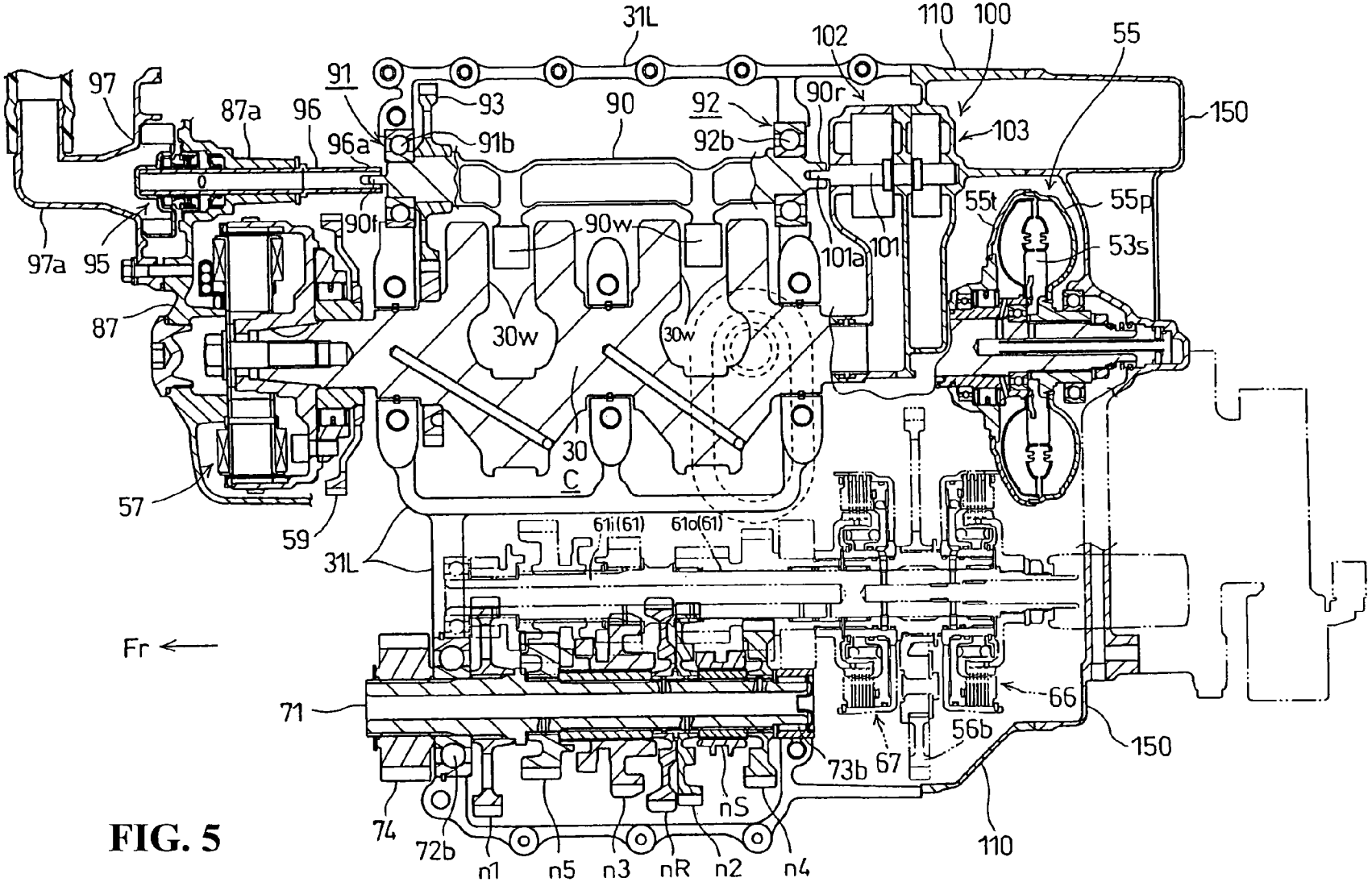
FIG. 5 is a cross-sectional view of the power unit (taken along the lines V-V and V'-V' in FIG. 3)

Referring now to FIG. 5, the balancer shaft 90 is rotatably supported at the front end and the rear end thereof by bearing openings 91 and 92 formed on the front wall and the rear wall of the upper and lower crankcases 31U and 31L via bearings 91*b* and 92*b* respectively.

The balancer shaft 90 is arranged at a position as close as possible to the crankshaft 30. As shown in FIG. 5, balancer weights 90W of the balancer shaft 90 are overlapped with (counter weights of) crank webs 30*w* of the crankshaft 30 in the direction of the crankshaft (fore-and-aft direction).

A driven gear 93 is spline-fitted to the bearing 91*b* fitted at the front end of the balancer shaft 90 adjacent to the inside of the bearing 91*b*, and the driven gear 93 meshes with the balancer shaft drive gear 54 fitted to the crankshaft 30 so that the rotation of the crankshaft 30 is transmitted to the balancer shaft 90 at the same revolving speed.

Therefore, primary vibrations caused by the reciprocal motion of the pistons 40 are cancelled by the rotation at the same speed as the crankshaft 30 of the balancer shaft 90.

A water pump 95 provided on a front cover member 87 for covering the AC generator 57 or the like from the front is provided forwardly of the balancer shaft 90. In addition, a water pump drive shaft 96 rotatably supported by a bearing cylinder 87*a* of the front cover member 87 is arranged coaxially with the balancer shaft 90.

A connecting projection 90*f* projecting forward from the front end of the balancer shaft 90 and a connecting recess 96*a* formed at the rear end of the water pump drive shaft 96 are fitted so that the rotation of the balancer shaft 90 is transmitted to the water pump drive shaft 96 to drive the water pump 95.

The front side of the water pump 95 is covered with a water pump cover 97 provided with an intake cylinder 97*a*.

The intake cylinder 97*a* of the water pump cover 97 is connected by the radiator 27 and a water piping arranged on the front side of the vehicle body, so that the water pump 95 sucks cooling water from the radiator 27.

On the other hand, an oil pump unit 100 provided on the spacer 110 is disposed rearwardly of the balancer shaft 90. In addition, an oil pump drive shaft 101 rotatably supported by the oil pump unit 100 is arranged coaxially with the balancer shaft 90.

A connecting recess 90*r* formed at the rear end of the balancer shaft 90, and a connecting projection 101*a* projecting at the front end of the oil pump drive shaft 101 are fitted, so that the rotation of the balancer shaft 90 is transmitted to the oil pump drive shaft 101 to drive the oil pump unit 100.

A dry sump system is employed for lubrication of the power unit P. Both rotors of a scavenge pump 102 and a feed pump 103 are mounted to the oil pump drive shaft 101 of the oil pump unit 100.

As described above, since the water pump drive shaft 96 is coaxially connected to the front end of the balancer shaft 90 and the oil pump drive shaft 101 is coaxially connected to the rear end thereof, the three shafts are connected coaxially. Thus, the number of the revolving shafts arranged in parallel to the crankshaft 30 that are apart from each other may be reduced. Therefore, a complicated power transmission mechanism is not necessary between the revolving shafts, so that the internal combustion engine may be downsized.

Since the balancer shaft 90 is arranged at a position where the crank webs 30*w* of the crankshaft 30 and the balancer weights 90W are overlapped in the axial direction, the internal combustion engine E is further downsized by an extent corresponding to the proximity of the balancer shaft 90 with respect to the crankshaft 30.

The structure of the cylinder head 33 of the internal combustion engine E as described above is shown in FIG. 6 and FIG. 7.

Figure 7:
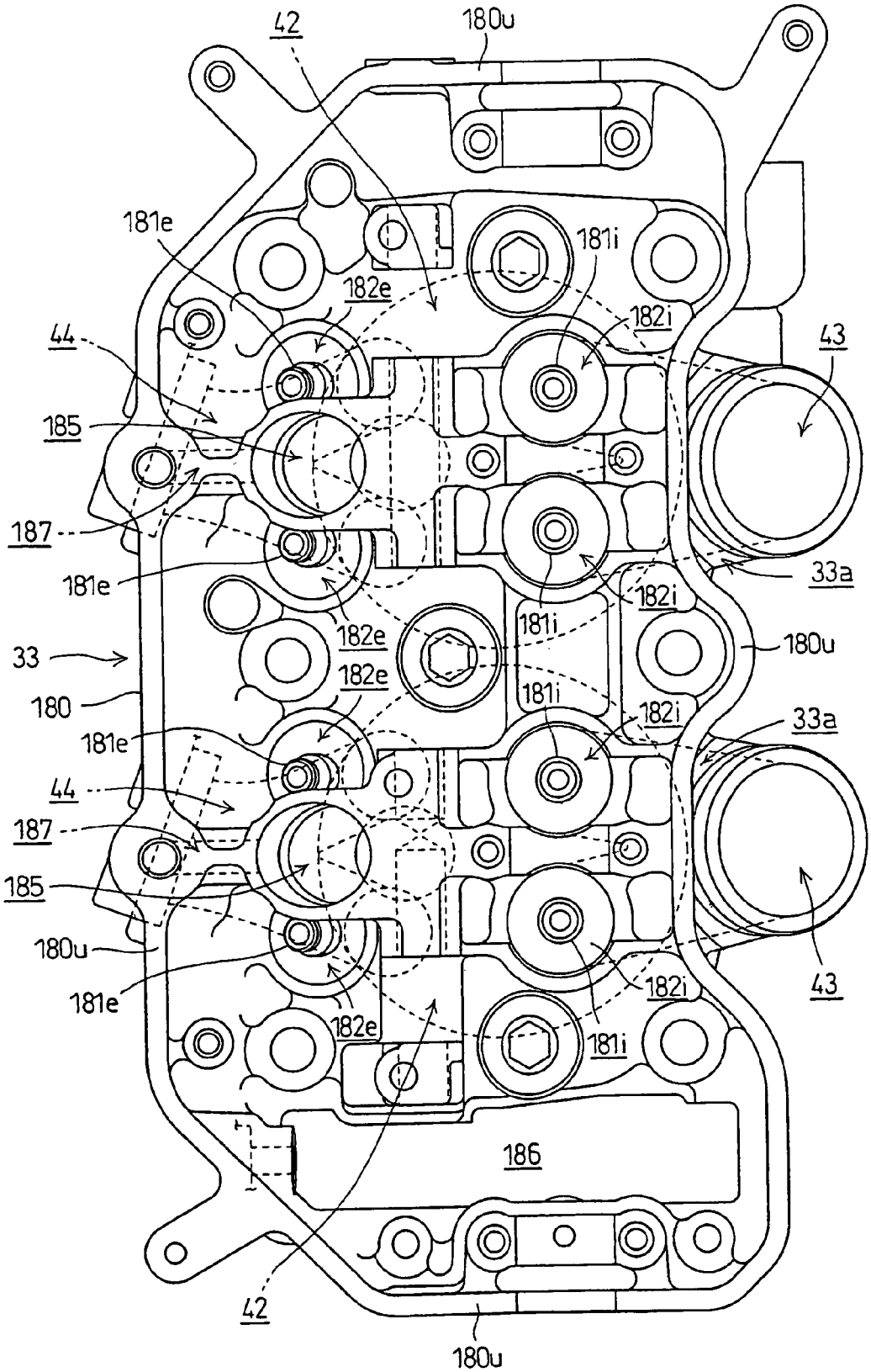
FIG. 7 is a plan view of a cylinder head.

FIG. 7 is a plan view of the cylinder head 33.

As shown in FIG. 7, the cylinder head 33 includes an outer wall 180 which is formed almost into a rectangular frame elongated in the fore-and-aft direction with the upper end surface of the outer wall 180 corresponding to a mating surface 180*u* with respect to the cylinder head cover 34.

The respective combustion chambers 42 corresponding to both cylinder bores 32*c* and 32*c* are formed with two openings of the air-intake port 43 and two openings of exhaust ports 44, cylindrical valve guide cylinders 181*i* are inserted corresponding to the openings of the air-intake ports 43 to form circular lifter guide holes 182*i*. In addition, cylindrical valve guide cylinders 181*e* are inserted corresponding to the openings of the exhaust port 44 to form circular guide holes 182*e*.

The two air-intake ports 43 extending obliquely upwardly and rightward from the two openings of the combustion chamber 42 are joined into one, which extends substantially upwardly and slightly inflectionally.

The two exhaust ports 44 extending obliquely upwardly and to the left from the two openings of the combustion chamber 42 are joined into one, which extends to the left and slightly inflectionally.

Formed between the lifter guide holes 182*i* and 182*i* on the side of the air-intake ports 43 are bearings 183 each having a semicircular portion for rotatably supporting the camshaft 48.

The bearing 183 is formed with a semicircular portion 183*a* for rotatably supporting the camshaft 48 on an upper end surface which forms the identical plane to the mating surface 180*u*.

The camshaft 48 is rotatably supported above the four lifter guide holes 182*i* arranged in line in the fore-and-aft direction so as to be clamped between the bearings 183 and camshaft holders 184.

Provided between the guide holes 182*e* and 182*e* on the side of the exhaust ports 44 are insertion holes 185 for inserting ignition plugs 47.

Provided at the rear of the cylinder head 33 is a chain chamber 186 in which the timing chain 51 to be wound around the cam sprocket 48*s* and the cam sprocket 48*s* which are fitted to the rear portion of the camshaft 48 is provided.

Secondary air introducing channels 187 which communicate with the exhaust ports 44 are formed on the side of the exhaust ports 44.

The air-intake valves 45 are reciprocably supported by the valve guide cylinders 181*i* and the lifter guide holes 182*i* of the cylinder head 33, and the exhaust valves 46 are reciprocably supported by the valve guide cylinders 181*e* and the guide holes 182*e*.

In other words, the air-intake valve 45 is configured in such a manner that the valve stem 45*s* thereof is inserted into the valve guide cylinder 181*i* with a valve lifter 451 provided at the upper end of the valve stem 45*s* via a retainer 45*r* being slidably fitted into the lifter guide hole 182*i*, and a valve spring 45*sp* being interposed between the retainer 45*r* and a fixed portion of the valve guide cylinder 181*i*.

The exhaust valve 46 is configured in such a manner that a valve stem 46*s* thereof is inserted into the valve guide cylinder 181*e*. A screw 50*a* at one end of the rocker arm 50 comes directly into abutment with the upper end of the valve stem 46*s*. A retainer 46*r* fitted to the upper end of the valve stem 46*s* is slidably fitted into the guide hole 182*e* with a valve spring 46*sp* being interposed between the retainer 46*r* and the fixed portion of the valve guide cylinder 181*e*.

Therefore, when the camshaft 48 rotates, air-intake cam lobes 48*i* on the camshaft 48 press directly against the valve lifters 451 to reciprocate the air-intake valves 45 in parallel with the direction parallel to the direction of reciprocal motion of the pistons 40, so that the openings of the air-intake ports 43 opening into the combustion chambers 42 are opened and closed at a predetermined timing. Simultaneously, the exhaust cam lobes 48*e* on the camshaft 48 pivot the rocker arms 50 and screws 50*a* at the one ends of the rocker arms 50 press the upper ends of the valve stems 46*s* to reciprocate the exhaust valves 46, so that the openings of the exhaust ports 44 opened into the combustion chambers 42 are opened and closed at a predetermined timing.

The right outer wall 180 of the outer wall 180 of the cylinder head 33, which is formed almost into a rectangular shape, is formed with a recess 33*a* which is formed by depressing a portion where the air-intake ports 43 extend inwardly, and the outer wall of the cylinder head cover 34 to be laid on the cylinder head 33 is also formed with a recess 34*a* continuing from the recess 33*a* of the cylinder head 33.

The air-intake ports 43 extend toward the cylinder head cover 34 (substantially upwardly) along the recess 33*a* on the outer surface of the right outer wall 180 of the cylinder head 33, and are connected to the intake manifolds 20 at a position far before reaching the identical plane to the mating surface 180*u* with respect to the cylinder head cover 34.

Connecting portions 43*a* of the air-intake ports 43 with respect to the intake manifolds 20 are located beside the lifter guide holes 182*i* of the air-intake valves 45.

The intake manifolds 20 connected to the air-intake ports 43 extend substantially upwardly along the recess 33*a* of the cylinder head 33 and the continuous recess 34*a* of the cylinder head cover 34.

The fuel injection device 21I is interposed at the midway of the intake manifold 20 together with the throttle body 21.

The air-intake ports 43 extend substantially upwardly along the recess 33*a* formed on the right outer surface of the cylinder head 33 so as to have less outward projection are connected to the intake manifolds 20 beside the lifter guide holes 182*i* of the air-intake valves 45 significantly before reaching the identical plane to the mating surface between the cylinder head 33 and the cylinder head cover 34. Thus, the lateral width of the cylinder head 34 may be reduced to achieve downsizing.

As shown in FIG. 3, at the left and right sides of the cylinder head cover 34, the pair of left and right upper pipes 3*a* and 3*a* of the center frame portion 3 extend in the fore-and-aft direction. In addition, the intake manifolds 20 extend upwardly to substantially the same level as the mating surface between the cylinder head 33 and the cylinder head cover 34 between the cylinder head 33 and the right upper pipe 3*a* and are connected to the throttle body 21 so that the throttle body 21 does not interfere with the right upper pipe 3*a*.

The air-intake port 43 and the intake manifold 20 extend inflectionally upwardly along the recess 33*a* formed on the right outer surface of the cylinder head 33. However, since the fuel injection device 21I is mounted at a short distance from the combustion chambers 42, and is mounted to the right side of the throttle body 21 of the intake manifolds 20, the fuel injection of the fuel injection devices 21I may be directed toward the openings of the combustion chambers 42 of the air-intake port 43, so that the fuel may be supplied efficiently to the combustion chamber 42 as shown in FIG. 6.

Figure 6:
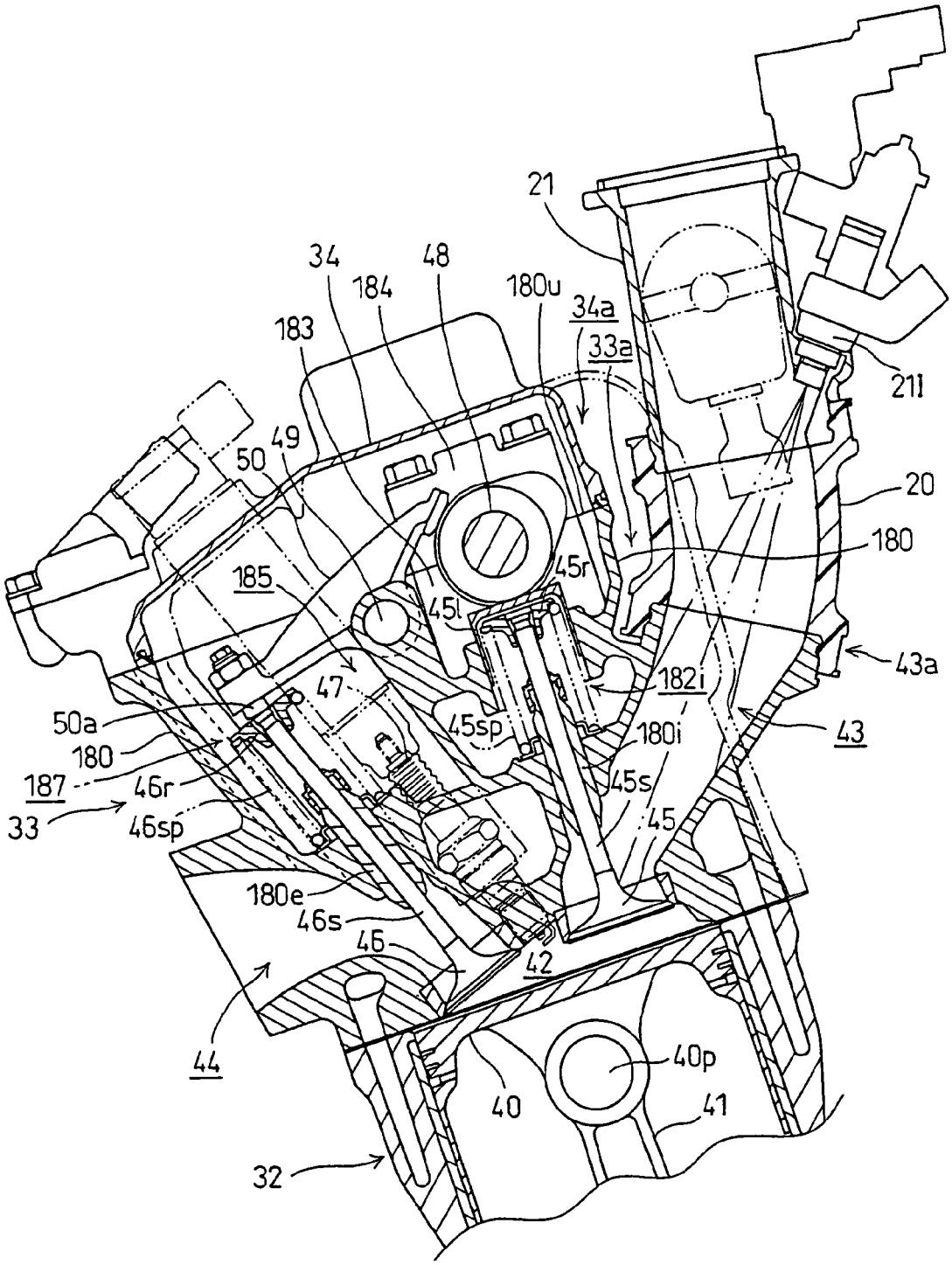
FIG. 6 is a cross-sectional view of a principal portion of an internal combustion engine.

Since the connecting portions 43*a* between the air-intake ports 43 and the intake manifolds 20 are located beside the lifter guide holes 182*i* of the cylinder heads 33 which slidably support the valve lifters 451 of the air-intake valves 45, the lifter guide holes 182*i* may be protected by the intake manifolds 20 as shown in FIG. 6.

Furthermore, although the camshaft 48 is rotatably supported on the identical plane to the mating surface 180*u* of the cylinder head 33 with respect to the cylinder head cover 34 so as to be clamped between the bearings 183 and the camshaft holders 184, since the intake manifolds 20 extend substantially upwardly along the recesses 33*a*, 34*a* of the cylinder head 33 and the cylinder head cover 34 on the right side of the camshaft 48, the intake manifolds 20 may protect the camshaft 48.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-intake structure of an internal combustion engine comprising:

air-intake valves supported by a cylinder head having integrally formed air-intake ports so as to reciprocate in parallel with the direction of reciprocal motion of pistons, exhaust valves supported by the cylinder head having integrally formed exhaust ports so as not to reciprocate in parallel with the direction of reciprocal motion of pistons;

at least one ignition plug secured into an insertion hole of the cylinder head, the insertion hole extending in a direction that is substantially parallel to axes of the exhaust valves, and fuel injection devices formed integrally with a throttle body are provided on intake manifolds to be connected to the air-intake ports, wherein the air-intake ports extending toward the cylinder head cover along a recess formed on the outer surface of the cylinder head are connected to the intake manifolds at positions just before reaching the identical plane to a mating surface between the cylinder head and the cylinder head cover.

2. The air-intake structure of an internal combustion engine according to claim 1, wherein connecting portions between the air-intake ports and the intake manifolds are positioned beside lifter guide holes of the cylinder head which slidably support valve lifters of the air-intake valves.

3. The air-intake structure of an internal combustion engine according to claim 1, wherein a camshaft for directly pressing the air-intake valves is positioned on the mating surface between the cylinder head and the cylinder head cover, and a recess which continues from the recess of the cylinder head is formed also on the cylinder head cover which is to be laid on the cylinder head, and in that the intake manifolds to be connected to the air-intake ports extend along the recess of the cylinder head cover.

4. The air-intake structure of an internal combustion engine according claim 1, wherein the insertion hole is formed between a pair of guide holes for the exhaust valves.

5. The air-intake structure of an internal combustion engine according to claim 1, wherein the air-intake ports integrally formed with the cylinder head and extend upwardly and outwardly therefrom.

6. The air-intake structure of an internal combustion engine according to claim 5, wherein the intake manifold is operatively connected to the air-intake ports and is disposed a predetermined distance relative to the cylinder head for spacing the throttle body relative to the cylinder head.

7. The air-intake structure of an internal combustion engine according to claim 1, wherein an opening plane of the air-intake port opening into a combustion chamber extends in parallel to and separated from the mating surface of the cylinder head with respect to the cylinder block.

8. An air-intake structure of an internal combustion engine comprising:

air-intake valves supported by a cylinder head having integrally formed air-intake ports so as to reciprocate in parallel with the direction of reciprocal motion of pistons;

exhaust valves supported by the cylinder head having integrally formed exhaust ports;

at least one ignition plug secured to the cylinder head, the ignition plug extending in a direction that is parallel to one of an axial direction of the air-intake valves and an axial direction of the exhaust valves, and is not parallel to the other the axial direction of the air-intake valves and the axial direction of the exhaust valves; and fuel injection devices formed integrally with a throttle body, said fuel injection devices being provided on intake manifolds to be connected to the air-intake ports;

wherein the air-intake ports extend toward a cylinder head cover along a recess formed on the outer surface of the cylinder head, said air-intake ports being connected to the intake manifolds at positions just before reaching the identical plane to a mating surface between the cylinder head and the cylinder head cover.

9. The air-intake structure of an internal combustion engine according to claim 8, wherein connecting portions between the air-intake ports and the intake manifolds are positioned beside lifter guide holes of the cylinder head which slidably support valve lifters of the air-intake valves.

10. The air-intake structure of an internal combustion engine according to claim 8, wherein a camshaft for directly pressing the air-intake valves is positioned on the mating surface between the cylinder head and the cylinder head cover, and a recess which continues from the recess of the cylinder head is formed also on the cylinder head cover which is to be laid on the cylinder head, and in that the intake manifolds to be connected to the air-intake ports extend along the recess of the cylinder head cover.

11. The air-intake structure of an internal combustion engine according to claim 9, wherein an insertion hole for inserting the ignition plug is formed in the cylinder head between a pair of guide holes for the exhaust valves.

12. The air-intake structure of an internal combustion engine according to claim 8, wherein the air-intake ports integrally formed with the cylinder head and extend upwardly and outwardly therefrom.

13. The air-intake structure of an internal combustion engine according to claim 12, wherein the intake manifold is operatively connected to the air-intake ports and is disposed a predetermined distance relative to the cylinder head for spacing the throttle body relative to the cylinder head.

14. The air-intake structure of an internal combustion engine according to claim 8, wherein an opening plane of the air-intake port opening into a combustion chamber extends in parallel to and separate from the mating surface of the cylinder head with respect to the cylinder block.

15. An air-intake structure of an internal combustion engine comprising:

a cylinder head;

air-intake valves supported by the cylinder head;

air-intake ports integrally formed with the cylinder head wherein the air-intake valves reciprocate in parallel with the direction of reciprocal motion of pistons;

exhaust valves supported by the cylinder head having integrally formed exhaust ports;

an ignition plug secured to the cylinder head, the ignition plug extending in a direction that is parallel to one of an axial direction of the air-intake valves and an axial direction of the exhaust valves, and is not parallel to the other the axial direction of the air-intake valves and the axial direction of the exhaust valves;

a throttle body;

fuel injection devices formed integrally with the throttle body; and intake manifolds, said fuel injection devices being provided on the intake manifolds and in communication with the air-intake ports;

wherein the air-intake ports extend toward a cylinder head cover along a recess formed on the outer surface of the cylinder head, said air-intake ports being connected to the intake manifolds at positions just before reaching the identical plane to a mating surface between the cylinder head and the cylinder head cover.

16. The air-intake structure of an internal combustion engine according to claim 15, wherein connecting portions between the air-intake ports and the intake manifolds are positioned beside lifter guide holes of the cylinder head which slidably support valve lifters of the air-intake valves.

17. The air-intake structure of an internal combustion engine according to claim 15, wherein a camshaft for directly pressing the air-intake valves is positioned on the mating surface between the cylinder head and the cylinder head cover, and a recess which continues from the recess of the cylinder head is formed also on the cylinder head cover which is to be laid on the cylinder head, and in that the intake manifolds to be connected to the air-intake ports extend along the recess of the cylinder head cover.

18. The air-intake structure of an internal combustion engine according to claim 15, wherein the exhaust valves are arranged so as not to reciprocate in parallel with the direction of reciprocal motion of pistons.

19. The air-intake structure of an internal combustion engine according to claim 15, wherein the air-intake ports integrally formed with the cylinder head and extend upwardly and outwardly therefrom.

20. The air-intake structure of an internal combustion engine according to claim 19, wherein the intake manifold is operatively connected to the air-intake ports and is disposed a predetermined distance relative to the cylinder head for spacing the throttle body relative to the cylinder head.

* * * * *